US010087389B2

(12) United States Patent
Matsuki et al.

(10) Patent No.: US 10,087,389 B2
(45) Date of Patent: Oct. 2, 2018

(54) LUBRICATING OIL COMPOSITION

(71) Applicant: JX Nippon Oil & Energy Corporation, Tokyo (JP)

(72) Inventors: Shingo Matsuki, Tokyo (JP); Go Tatsumi, Tokyo (JP); Hironori Isoh, Tokyo (JP); Isao Kurihara, Tokyo (JP); Masaaki Itou, Tokyo (JP)

(73) Assignee: JX Nippon Oil & Energy Corporation, Tokyo (JP)

( * ) Notice: Subject to any disclaimer, the term of this patent is extended or adjusted under 35 U.S.C. 154(b) by 0 days.

(21) Appl. No.: 15/115,956

(22) PCT Filed: Sep. 16, 2014

(86) PCT No.: PCT/JP2014/074427
§ 371 (c)(1),
(2) Date: Aug. 2, 2016

(87) PCT Pub. No.: WO2015/118716
PCT Pub. Date: Aug. 13, 2015

(65) Prior Publication Data

US 2017/0198234 A1 Jul. 13, 2017

(30) Foreign Application Priority Data

Feb. 7, 2014 (JP) ..... 2014-022273

(51) Int. Cl.
*C10M 163/00* (2006.01)
*C10M 141/10* (2006.01)
*C10M 141/12* (2006.01)

(52) U.S. Cl.
CPC ..... *C10M 141/10* (2013.01); *C10M 141/12* (2013.01); *C10M 163/00* (2013.01)

(58) Field of Classification Search
CPC ..... C10M 2215/28; C10M 2223/041; C10M 2219/106; C10M 2207/262
USPC ..... 508/185
See application file for complete search history.

(56) References Cited

U.S. PATENT DOCUMENTS

| | | | | |
|---|---|---|---|---|
| 6,451,745 | B1 * | 9/2002 | Ward | C10M 163/00 508/186 |
| 2003/0013619 | A1 * | 1/2003 | Sato | C10M 163/00 508/192 |
| 2004/0192562 | A1 | 9/2004 | Morita | |
| 2009/0275491 | A1 | 11/2009 | Komatsubara et al. | |
| 2012/0245068 | A1 * | 9/2012 | Scanlon | C10M 145/14 508/469 |

FOREIGN PATENT DOCUMENTS

| | | | |
|---|---|---|---|
| JP | 2002003875 | A | 1/2002 |
| JP | 2003-041283 | A | 2/2003 |
| JP | 2003113391 | A | 4/2003 |
| JP | 2006117854 | A | 5/2006 |
| JP | 2007126543 | A | 5/2007 |
| JP | 2009096925 | A | 5/2009 |

OTHER PUBLICATIONS

"Internal Combustion Engine Oils", JIS Handbook 25 Sekiyu, pp. 190-193, (Jun. 26, 2006).
International Search Report dated Nov. 26, 2014 in International Application No. PCT/JP2014/074427.

* cited by examiner

*Primary Examiner* — Vishal Vasisth
(74) *Attorney, Agent, or Firm* — Panitch Schwarze Belisario & Nadel LLP

(57) ABSTRACT

A lubricating oil composition containing a lubricating base oil and on the basis of the total mass of the composition, (A) a boron-containing ashless dispersant in an amount of 100 to 500 ppm by mass as boron, (B) a phosphorous additive in an amount of 300 to 800 ppm by mass as phosphorus, (C) an amide- and/or imide-based friction modifier in an amount of 1 to 4 percent by mass, and (D) an alkali metal- and/or alkaline earth metal-based detergent in an amount of 100 to 300 ppm by mass as metal, and having a 40° C. kinematic viscosity of 30 mm2/s or lower is provided. The lubricating oil composition, which has a low viscosity to improve fuel efficiency, also has superior anti-wear, anti-seizure, and anti-shattering properties, even when the composition is degraded by oxidation or by the elution of compounds from sealing materials after long term use.

8 Claims, No Drawings

LUBRICATING OIL COMPOSITION

CROSS-REFERENCE TO RELATED APPLICATION

This application is a 371 of PCT/JP14/74427, filed Sep. 16, 2014.

TECHNICAL FIELD

The present invention relates to lubricating oil compositions, more specifically to a lubricating oil composition having high load bearing properties equivalent to those of the composition when it was a fresh oil even after being degraded, i.e., having long working life, particularly suitable for transmissions of automobiles, more particularly suitable as an automatic transmission oil.

BACKGROUND ART

It has been ruled that from the year of 2015, a new fuel efficiency consumption regulation would be imposed on domestic automobiles, and an improvement in the fuel saving properties of an automobile has been demanded increasingly year by year. Lubricating oils used for the transmissions and internal combustion engines of automobiles have been demanded to contribute to energy saving, and lowering of the viscosity of a lubricating oil is an example of the contribution. Lowering of the viscosity of a lubricating oil to be used for example in a transmission can reduce the stir and frictional resistances and thus enhance the power transmission efficiency, resulting in an improvement in the fuel efficiency of an automobile. However, when the viscosity of a lubricating oil is lowered, the oil film thickness is decreased, resulting in degradations in anti-wear properties and anti-seizure properties and accordingly some modifications to the base oil and additives to be used is required (see Patent Literatures 1 and 2).

Whilst, a lubricating oil, in particular a transmissions oil is required to have long service life characteristics that can retain main properties such as anti-wear properties, anti-seizure properties and the like for a long period of time. However, sufficient care in respect of anti-wear properties and anti-seizure properties considering the long service life characteristics thereof after degradation of an oil composition has not been given to the transmission lubricating oil compositions disclosed in the above patent literatures.

With regard to the degradation, it has been found that other than degradation of a lubricating oil composition due to oxidation after the use thereof for a long period of time, compounds eluted from sealing materials, i.e., rubber materials used in a transmission adversely affect the anti-wear properties of the lubricating oil composition. It has become apparent that this also adversely affects the friction characteristics, particularly the retainability of anti-shudder properties particularly needed as an automatic transmission oil.

CITATION LIST

Patent Literature

Patent Literature 1: Japanese Patent Application Laid-Open Publication No. 2006-117854

Patent Literature 2: Japanese Patent Application Laid-Open Publication No. 2009-96925

SUMMARY OF INVENTION

Technical Problem

In view of the foregoing circumstances, the present invention has an object to provide a lubricating oil composition which is low in viscosity for improving the fuel efficiency and still excellent in anti-wear properties and anti-seizure properties, and is also excellent in the retainability of these properties and of anti-shudder properties even when the composition is degraded caused by oxidation or compounds that are eluted from sealing materials after a long term use in order to acquire long service life characteristics.

Solution to Problem

As the results of extensive studies to achieve the above object, the present invention has been accomplished on the basis of the finding that the above object was able to be achieved with a lubricating oil composition comprising a boron-containing ashless dispersant, a phosphorous additive, an amide- and/or imide-based friction modifier, and an alkali metal- and/or alkaline earth metal-based detergent in specific amounts and specific ratios.

That is, the present invention relates to a lubricating oil composition comprising a lubricating base oil and on the basis of the total mass of the composition, (A) a boron-containing ashless dispersant in an amount of 100 to 500 ppm by mass as boron, (B) a phosphorous additive in an amount of 300 to 800 ppm by mass as phosphorus, (C) an amide- and/or imide-based friction modifier in an amount of 1 to 4 percent by mass, and (D) an alkali metal- and/or alkaline earth metal-based detergent in an amount of 100 to 300 ppm by mass as metal and having a 40° C. kinematic viscosity of 30 $mm^2/s$ or lower.

The present invention also relates to the foregoing lubricating oil composition wherein the phosphorus additive of Component (B) contains a phosphite ester.

The present invention also relates to the foregoing lubricating oil composition wherein the phosphorus additive of Component (B) is a combination of a phosphite ester and phosphoric acid and has a ratio ([P2]/[P1]) of the phosphorus amount [P2] of the phosphoric acid to the phosphorus amount [P1] of the phosphite ester of 0.2 to 1.5.

The present invention also relates to the foregoing lubricating oil composition wherein the alkali metal- and/or alkaline earth metal-based detergent of Component (D) is a combination of a metallic detergent having a base number of 150 mgKOH/g or greater and a metallic detergent having a base number of less than 150 mgKOH/g.

The present invention also relates to the foregoing lubricating oil composition wherein it has a ratio ([M]/[P]) of the metal amount [M] of the metallic detergent having a base number of less than 150 mgKOH/g of Component (D) to the phosphorus amount [P] of the phosphorus additive of Component (B) of 0.06 to 0.3.

The present invention also relates to the foregoing lubricating oil composition further comprising (E) a thiadiazole in an amount of 250 to 1000 ppm by mass as sulfur on the basis of the total mass of the composition.

The present invention also relates to the foregoing lubricating oil composition wherein it is used in a vehicle transmission.

Advantageous Effect of Invention

The lubricating oil composition of the present invention is a lubricating oil composition which is suitable as a transmission oil and is low in viscosity to improve fuel efficiency but is still excellent in anti-wear properties and anti-seizure properties and is also excellent in anti-wear properties and anti-seizure properties even after being degraded in order to acquire long service life characteristics. The composition also has long-lasting anti-shudder properties as an automatic transmission oil. The composition is, therefore, suitably used in vehicle transmissions.

The lubricating oil composition of the present invention is also excellent in performances required of transmission fluids other than those described above and thus is suitably used for the automatic or manual transmission and the differential gears, of automobiles, construction machines and agricultural machines. Moreover, the lubricating oil composition can be used as gear oils for industrial uses; lubricating oils for the gasoline engines, diesel engines or gas engines of automobiles such as two- and four-wheeled vehicles, power generators, and ships; turbine oils; and compressor oils.

DESCRIPTION OF EMBODIMENTS

The present invention will be described in detail below.

No particular limitation is imposed on the lubricating base oil of the lubricating oil composition of the present invention, which may, therefore, be any of mineral base oils and synthetic base oils that are used in ordinary lubricating oils.

Specific examples of the mineral base oil include those which can be produced by subjecting a lubricating oil fraction produced by vacuum-distilling an atmospheric distillation bottom oil resulting from atmospheric distillation of a crude oil, to any one or more treatments selected from solvent deasphalting, solvent extraction, hydrocracking, hydroisomerization, solvent dewaxing, and hydrorefining; wax-isomerized mineral oils; and those produced by isomerizing GTL WAX (Gas to Liquid Wax).

Specific examples of the synthetic base oils include polybutenes and hydrogenated compounds thereof; poly-α-olefins such as 1-octene oligomer, 1-decene oligomer and 1-dodecene oligomer or hydrogenated compounds thereof; diesters such as ditridecyl glutarate, di-2-ethylhexyl adipate, diisodecyl adipate, ditridecyl adipate and di-2-ethylhexyl sebacate; polyol esters such as neopentylglycol ester, trimethylolpropane caprylate, trimethylolpropane pelargonate, pentaerythritol 2-ethylhexanoate and pentaerythritol pelargonate; aromatic synthetic oils such as alkylnaphthalenes, alkylbenzenes, and aromatic esters; and mixtures of the foregoing.

The lubricating base oil used in the present invention may be any one of the above-described mineral base oils and synthetic base oils or a mixture of two or more types selected therefrom. For example, the base oil may be one or more types of the mineral base oils, one or more types of the synthetic base oils or a mixed oil of one or more types of the mineral base oils and one or more types of the synthetic base oils.

Although no particular limitation is imposed on the kinematic viscosity of the lubricating base oil used in the present invention, the base oil is preferably adjusted to have a 100° C. kinematic viscosity of preferably 1.5 to 5 $mm^2/s$, more preferably 1.5 to 4.5 $mm^2/s$, particularly preferably 1.5 to 4.0 $mm^2/s$. A base oil with a 100° C. kinematic viscosity of higher than 5 $mm^2/s$ is not preferable because the resulting composition will be poor in fuel saving properties. Whilst, a base oil having a kinematic viscosity of lower than 1.5 $mm^2/s$ is not preferable because the resulting lubricating oil composition would be poor in lubricity due to its insufficient oil film formation at lubricating sites and would be large in evaporation loss of the composition.

No particular limitation is imposed on the sulfur content of the lubricating base oil used in the present invention, which is, however, preferably 0.1 percent by mass or less, more preferably 0.05 percent by mass or less, more preferably 0.01 percent by mass or less.

The lubricating oil composition of the present invention contains a boron-containing ashless dispersant as Component (A).

The boron-containing ashless dispersant may be any ashless dispersant if it contains boron in the structure and for example, may be a boronated ashless dispersant produced by boronating an ashless dispersant.

Boronation of an ashless dispersant is generally carried out by allowing a nitrogen-containing compound to react with boric acid to neutralize the whole or part of the remaining amino and/or imino groups.

Examples of a method for producing a boronated succinimide include those disclosed in Japanese Patent Publication Nos. 42-8013 and 42-8014 and Japanese Laid-Open Patent Publication Nos. 51-52381 and 51-130408. More specifically, a boronated succinimide may be produced by mixing polyamine and polybutenylsuccinic acid (anhydride) with a boron compound such as boric acid, a boric acid ester, or a borate in a solvent including alcohols, organic solvent such as hexane or xylene, or a light fraction lubricating base oil and by heating the mixture under appropriate conditions. The boron content of the boron-modified succinimide thus produced is generally from 0.1 to 45 percent by mass.

Examples of the boronated ashless dispersant include boronated products of nitrogen-containing compounds having per their molecules at least one succinimides having in their molecules at least one straight-chain or branched alkyl or alkenyl group having 40 to 400 carbon atoms or derivatives thereof. Any one or more types selected from these ashless dispersants may be blended in the lubricating oil composition of the present invention.

Component (A) may be any boronated ashless dispersant that is usually used in a lubricating oil but is preferably a boronated succinimide because of the excellent detergency thereof.

Examples of the succinimide include alkyl- or alkenylsuccinimides having a straight-chain or branched alkyl or alkenyl group having preferably 40 to 400, more preferably 60 to 350 carbon atoms. If the carbon number of the alkyl or alkenyl group is fewer than 40, the ashless dispersant would tend to be degraded in solubility in the lubricating base oil. Whereas, if the carbon number of the alkyl or alkenyl group is more than 400, the resulting lubricating oil composition would be degraded in low-temperature fluidity. The alkyl or alkenyl group may be straight-chain or branched but is preferably a branched alkyl or alkenyl group derived from oligomers of olefins such as propylene, 1-butene or isobutylene or a cooligomer of ethylene and propylene.

The succinimide may be mono-type or bis-type or a mixture thereof.

No particular limitation is imposed on the method of producing these succinimides. For example, a method may be used, wherein an alkyl or alkenyl succinimide produced by reacting a compound having an alkyl or alkenyl group having 40 to 400 carbon atoms with maleic anhydride at a temperature of 100 to 200° C. is reacted with a polyamine. Examples of the polyamine include diethylene triamine, triethylene tetramine, tetraethylene pentamine, and pentaethylene hexamine.

Alternatively, the boronated ashless dispersant may be a boronated benzylamine. Specific examples of preferred benzylamines include compound represented by formula (1) below:

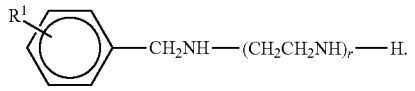

(1)

In formula (1), $R^1$ is an alkyl or alkenyl group having 40 to 400, preferably 60 to 350 carbon atoms, r is an integer of 1 to 5, preferably 2 to 4.

No particular limitation is imposed on the method for producing the benzylamines. They may be produced by reacting a polyolefin such as a propylene oligomer, polybutene, or ethylene-α-olefin copolymer with a phenol so as to produce an alkylphenol and then subjecting the alkylphenol to Mannich reaction with formaldehyde and a polyamine such as diethylenetriamine, triethylenetetramine, tetraethylenepentamine, or pentaethylenehexamine.

Alternatively, the boronated ashless dispersant may be a boronated polyamine. Specific examples of the boronated polyamine include boronated products of compounds represented by formula (2) below:

$$R—NH—(CH_2CH_2NH)_s—H \quad (2).$$

In formula (2), R is an alkyl or alkenyl group having 40 to 400, preferably 60 to 350 carbon atoms, and s is an integer of 1 to 5, preferably 2 to 4.

No particular limitation is imposed on the method for producing the polyamines. For example, the polyamines may be produced by chlorinating a polyolefin such as a propylene oligomer, polybutene, or ethylene-α-olefin copolymer and reacting the chlorinated polyolefin with ammonia or a polyamine such as ethylenediamine, diethylenetriamine, triethylenetetramine, tetraethylenepentamine, and pentaethylenehexamine.

Among these boronated ashless dispersants, boronated succinimides are preferably used because of their excellent detergency.

The content of Component (A) is, on the basis of the total mass of the composition as boron, from 100 to 500 ppm by mass, preferably 150 ppm by mass or more, more preferably 200 ppm by mass or more, more preferably 250 ppm by mass or more and preferably 450 ppm by mass or less, more preferably 400 ppm by mass or less, more preferably 350 ppm by mass or less. If the boron content is more than 500 ppm by mass, not only concerns about stability may be arisen but also the friction characteristics may be degraded due to too much boron content in the resulting composition. If the boron content is less than 100 ppm by mass, the resulting composition will lack in anti-wear properties and an effect to restrain the influences of compounds eluted from sealing materials.

No particular limitation is imposed on the boron/nitrogen mass ratio (B/N ratio) of the boron-containing ashless dispersant, which is usually from 0.05 to 5, preferably 0.2 or greater, more preferably 0.4 or greater, particularly preferably 0.7 or greater and preferably 2 or less, more preferably 1.5 or less, more preferably 1.0 or less, particularly preferably 0.9 or less. If the B/N ratio exceeds 5, concerns about stability may be arisen. If the B/N ratio is less than 0.05, the resulting composition will lack in anti-wear properties and an effect to restrain the influences of compounds eluted from sealing materials.

The molecular weight of Component (A) is determined by the carbon number of the alkyl or alkenyl group and the structure of the polyamine of the above-described ashless dispersant and is preferably 2,500 or greater, more preferably 3,000 or greater, more preferably 4,000 or greater and preferably 10,000 or less, more preferably 8,000 or less. If Component (A) has a molecular weight of less than 2,500, it will be less in fuel saving effect. If Component (A) has a molecular weight of greater than 10,000, the synthesis thereof will be substantially difficult.

In the present invention, if the ashless dispersant to be used has a ratio of boron to nitrogen (B/N ratio) in the total amount within the above range, it may be mixed with a boron-free ashless dispersant. Examples of the boron-free ashless dispersant include compounds before being boronated to produce the above-described boronated ashless dispersants compound, specifically succinimides, benzylamines, and polyamines. For this case, succinimides are most preferably used.

However, a sole use of a boron-containing ashless dispersant, in particular a boronated succinimide is preferable. This is because among the boron-containing ashless dispersants, boronated succinimides are most stable and thus have less concern that boron compounds precipitate.

The lubricating oil composition of the present invention contains a phosphorous additive as Component (B).

No particular limitation is imposed on Component (B) that is a phosphorous additive if it contains phosphorous per molecule. Examples of the phosphorus additive include phosphate monoesters, phosphate diesters, phosphate triesters, phosphite monoesters, phosphite diesters, phosphite triesters, thiophosphate monoesters, thiophosphate diesters, thiophosphate triesters, thiophosphite monoesters, thiophosphite diesters, thiophosphite triesters, all having a hydrocarbon group of 1 to 30 carbon atoms, salts of these esters and amines or alkanol amines or metal salts such as zinc salt of these esters. Any one or more of these compounds may be arbitrarily blended.

Examples of the hydrocarbon group having 1 to 30 carbon atoms include alkyl, cycloalkyl, alkenyl, alkyl-substituted cycloalkyl, aryl, alkyl-substituted aryl and arylalkyl groups.

In the present invention, Component (B) that is a phosphorus additive is preferably one type of or a mixture of two or more types selected from phosphite esters or phosphate esters, having an alkyl group having 4 to 20 carbon atoms or an (alkyl)aryl group having 6 to 12 carbon atoms and amine salts produced by allowing alkylamines having an alkyl group having 1 to 18 carbon atoms to react with these esters, more preferably one type of or a mixture of two or more types selected from phosphite esters having an alkyl group having 4 to 20 carbon atoms such as dibutylphosphite and phosphite esters having an (alkyl) aryl group having 6 to 12 carbon atoms such as phenylphosphite and particularly preferably contains phosphite diesters having an (alkyl)aryl group having 6 to 12 carbon atoms such as diphenylphosphite.

The content of Component (B) that is a phosphorus additive in the lubricating oil composition is from 300 to 800 ppm by mass, preferably 400 ppm by mass or more, particularly preferably 500 ppm by mass or more and preferably 700 ppm by mass or less as phosphorus on the basis of the total mass of the composition. The content of the phosphorus anti-wear agent set within the above range renders it possible to produce a composition having excellent anti-wear properties and anti-seizure properties after a rubber immersion test or an oxidation stability test.

Component (B) that is a phosphorus additive contains preferably a phosphite ester, particularly preferably a combination of a phosphite ester and phosphoric acid. A combination of a phosphite ester and phosphoric acid renders it possible to balance the anti-wear properties and the friction characteristics of the clutch of an automatic transmission well.

For that purpose, the ratio of the phosphite ester and phosphoric acid is a ratio ([P2]/[P1]) of the phosphorus amount [P2] of the phosphoric acid to the phosphorus amount [P1] of the phosphite ester of preferably 0.2 to 1.5, more preferably 0.3 or greater, and preferably 1 or smaller, most preferably 0.7 or smaller.

Since phosphoric acid is not dissolved as it is, it is preferably added, in the form of a mixture with an ashless dispersant.

The mass ratio ([B]/[P]) of the boron content [B] of Component (A) to the phosphorus content [P] of Component (B) in the lubricating oil composition of the present invention is preferably 0.3 or greater, more preferably 0.35 or greater, most preferably 0.4 or greater and preferably 1 or smaller, more preferably 0.8 or smaller, more preferably 0.7 or smaller. If the [B]/[P] is smaller than 0.3 or greater than 1, the balance between the anti-wear properties and the effect to restrain the elution of compounds from sealing materials is lost.

The lubricating oil composition of the present invention contains an amide- and/or imide-based friction modifier as Component (C).

Component (C) that is an amide- or imide-based friction modifier include fatty acid amide-based friction modifiers such as amides of straight-chain or branched, preferably straight-chain fatty acids and ammonia, aliphatic monoamine or aliphatic polyamines.

One specific example of the amide-based friction modifier is a fatty acid amide compound containing one nitrogen atom and having at least one alkyl or alkenyl group of 10 to 30 carbon atoms. More specific examples include fatty acid amides produced by reacting a fatty acid having an alkyl or alkenyl group having 10 to 30 carbon atoms or an acid chloride thereof with a nitrogen-containing compound such as ammonia or an amine compound having in its molecules only a hydrocarbon group or hydroxyl-containing hydrocarbon group having 1 to 30 carbon atoms.

The amide-based friction modifier is particularly preferably an amide compound having its terminal ends that are amide groups, produced by reacting ammonia and a fatty acid.

Specific particularly preferable examples of (C-1) the fatty acid amide include lauric acid amide, myristic acid amide, palmitic acid amide, stearic acid amide, oleic acid amide, coconut oil fatty acid amide, synthetic mixed fatty acid amide having 12 or 13 carbon atoms, and mixtures thereof in view of their excellent friction reducing effect.

Specific preferable examples of (C-2) other amide-based friction modifier include hydrazide (oleic acid hydrazide and the like), semicarbazide (oleyl semicarbazide and the like), urea (oleyl urea and the like), ureide (oleyl ureide and the like), allophanate amide (oleyl allophanate amide and the like), and derivatives thereof as exemplified in WO2005/037967 pamphlet.

Examples of other friction modifiers include urea compounds having an alkyl or alkenyl group having 12 to 24 carbon atoms, such as dodecyl urea, tridecyl urea, tetradecyl urea, pentadecyl urea, hexadecyl urea, heptadecyl urea, octadecyl urea, and oleyl urea, and acid modified derivatives thereof. Among these friction modifiers, particularly preferred are oleyl urea ($C_{18}H_{35}$—NH—C(=O)—$NH_2$) and acid modified derivatives (boric acid modified derivatives).

Furthermore, examples of other friction modifiers include hydrazide compounds having an alkyl or alkenyl group having 12 to 24 carbon atoms such as dodecanoic acid hydrazide, tridecanoic acid hydrazide, tetradecanoic acid hydrazide, pentadecanoic acid hydrazide, hexadecanoic acid hydrazide, heptadecanoic acid hydrazide, octadecanoic acid hydrazide, oleic acid hydrazide, erucic acid hydrazide and acid-modified derivatives thereof (boric acid-modified derivatives). Among these compounds, particularly preferable examples include oleic acid hydrazide ($C_{17}H_{33}$—C(=O)—NH—$NH_2$) and acid modified derivatives thereof, erucic acid hydrazide ($C_{21}H_{41}$—C(=O)—NH—$NH_2$) and acid modified derivatives thereof.

Examples of amide-based friction modifiers in another format include those having amide as a functional group and still having a hydroxyl group or carboxylic acid group in the same molecule.

Specific examples of the amide-based friction modifier having a hydroxyl group include fatty acid amides produced by reacting fatty acids having an alkyl or alkenyl group having 10 to 30 carbon atoms or acid chlorides thereof with nitrogen-containing compounds such as amine compounds containing only a hydroxyl group-containing hydrocarbon group having 1 to 30 carbon atoms per molecule.

Specifically, the amide-based friction modifier is preferably a compound represented by formula (3):

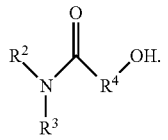

(3)

In formula (3), $R^2$ is a hydrocarbon or functionalized hydrocarbon group having 1 to 30 carbon atoms, preferably a hydrocarbon or functionalized hydrocarbon group having 10 to 30 carbon atoms, more preferably an alkyl, alkenyl or functionalized hydrocarbon group having 12 to 24 carbon atoms, and particularly preferably an alkenyl group having 12 to 20 carbon atoms, $R^3$ is a hydrocarbon or functionalized hydrocarbon group having 1 to 30 carbon atoms or hydrogen, preferably a hydrocarbon or functionalized hydrocarbon group having 1 to 10 carbon atoms or hydrogen, more preferably a hydrocarbon group having 1 to 4 carbon atoms or hydrogen, more preferably hydrogen, and $R^4$ is a divalent hydrocarbon or functionalized divalent hydrocarbon having 1 to 10 carbon atoms, preferably an alkylene group having 1 to 4 carbon atoms, more preferably a methylene or ethylene group, most preferably a methylene group.

The compound represented by formula (3) may be synthesized for example by reacting a hydroxylic acid with an aliphatic amine. The hydroxylic acid is preferably an aliphatic hydroxylic acid, more preferably a straight-chain aliphatic α-hydroxylic acid. The α-hydroxylic acid is preferably glycolic acid. The aliphatic amine is preferably a compound exemplified as an amine-based friction modifier described below.

In the present invention, specific examples of particularly preferable compounds include N-oleoylsarcosine.

Examples of the imide-based friction modifier include succinimide-based friction modifiers such as mono- and/or bis-succinimides having one or two straight-chain or branched, preferably branched hydrocarbon groups and succinimide-modified compounds produced by allowing such succinimides to react with one or more types selected from boric acid, phosphoric acid, carboxylic acids having 1 to 20 carbon atoms and sulfur-containing compounds.

Examples of the imide-based friction modifier include mono- and/or bis-succinimides represented by formula (4) and (5) below:

(4)

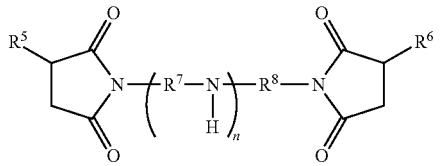

(5)

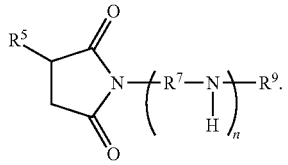

In above formulas (4) and (5), $R^5$ and $R^6$ are each independently an alkyl or alkenyl group having 8 to 30, preferably 12 to 24 carbon atoms, $R^7$ and $R^8$ are each independently an alkylene group having 1 to 4, preferably 2 or 3 carbon atoms, $R^9$ is hydrogen or an alkyl or alkenyl group having 1 to 30, preferably 8 to 30 carbon atoms, and n is an integer of 1 to 7, preferably 1 to 3.

The content of Component (C) in the lubricating oil composition of the present invention is from 1 to 4 percent by mass, preferably 2 percent by mass or more, more preferably 2.4 percent by mass or more and preferably 3.8 percent by mass or less, more preferably 3.6 percent by mass or less, more preferably 3.4 percent by mass or less on the basis of the total mass of the composition. If the content of the friction modifier is less than 2 percent by mass, the friction reducing effect attained thereby is likely to be insufficient. If the content is more than 4 percent by mass, the effect of anti-wear additives is likely to be blocked or the solubility of additives are likely to be degraded.

The nitrogen content of Component (C) in the lubricating oil composition of the present invention is, on the basis of the total mass of the composition, preferably 0.0005 to 0.4 percent by mass, more preferably 0.001 to 0.3 percent by mass, particularly preferably 0.005 to 0.25 percent by mass. This is because anti-wear properties are not sufficiently exhibited if the nitrogen content is too less and the solubility is degraded, causing precipitation or turbidity if the nitrogen content is too large.

The lubricating oil composition of the present invention contains an alkali metal- and/or alkaline earth metal-based detergent as Component (D). Examples of the metallic detergent include sulfonate-, phenate- and salicylate-based detergents.

Examples of the sulfonate-based detergent include alkaline earth metal salts, particularly preferably magnesium salts and/or calcium salts of alkyl aromatic sulfonic acids, produced by sulfonating an alkyl aromatic compound having a molecular weight of 100 to 1,500, preferably 200 to 700.

Specific examples of the alkyl aromatic sulfonic acids include petroleum sulfonic acids and synthetic sulfonic acids. The petroleum sulfonic acids may be those produced by sulfonating an alkyl aromatic compound contained in the lubricant fraction of a mineral oil or may be mahogany acid by-produced upon production of white oil. The synthetic sulfonic acids may be those produced by sulfonating an alkyl benzene having a straight-chain or branched alkyl group, produced as a by-product from a plant for producing an alkyl benzene used as the raw material of a detergent or produced by alkylating a polyolefin to benzene, or those produced by sulfonating alkylnaphthalenes such as dinonylnaphthalene.

Sulfonates produced using a polyolefin as an alkylating agent are particularly preferable in view of friction characteristics.

Typical examples of the metal sulfonate include: not only neutral alkaline earth metal sulfonates produced by reacting the above-mentioned alkyl aromatic sulfonic acid directly with an alkaline earth metal base such as an oxide or hydroxide of a metal or particularly in the case of an alkaline earth metal-based detergent produced by once converting the alkyl aromatic sulfonic acid to an alkali metal salt such as a sodium salt or a potassium salt and then substituting the alkali metal salt with an alkaline earth metal salt; but also basic alkaline earth metal sulfonates produced by heating such neutral alkaline earth metal salts and an excess amount of an alkaline earth metal salt or an alkaline earth metal base (hydroxide or oxide) in the presence of water; and carbonate overbased alkaline earth metal sulfonates and borate overbased alkaline earth metal sulfonates produced by reacting such neutral alkaline earth metal sulfonates with an alkaline earth metal base in the presence of carbonic acid gas and/or boric acid or borate.

Examples of the phenate-based detergent include alkaline earth metal salts of an alkylphenolsulfide produced by reacting an alkylphenol having at least one straight-chain or branched alkyl group having 4 to 30, preferably 6 to 18 carbon atoms with sulfur or a Mannich reaction product of an alkylphenol produced by reacting the alkylphenol with formaldehyde.

No particular limitation is imposed on the structure of the salicylate-based detergent. However, preferable examples include metal salts of salicylic acids having 1 or 2 alkyl groups having 1 to 30 carbon atoms. In particular, the salicylate-based detergent is preferably an alkylsalicylic acid metal salt and/or an (overbased) basic salt thereof, the component ratios of which monoalkylsalicylic acid metal salt and dialkylsalicylic acid metal salt are from 85 to 100 percent by mole and from 0 to 15 percent by mole respectively, and the component ratio of which 3-alkylsalicylic acid metal salt is from 40 to 100 percent by mole because it is excellent in anti-wear properties and anti-seizure properties after a rubber immersion test or an oxidation stability test.

Examples of the alkali metal include sodium and potassium, and examples of the alkaline earth metal include calcium and magnesium. Preferred are calcium and magnesium, and particularly preferred is calcium.

Metallic detergents used as Component (D) in the present invention are preferably sulfonates and salicylates in view of anti-wear properties and prevention of influences of sealing materials after more highly degraded and clutch friction characteristics of an automatic transmission.

Component (D) that is a metallic detergent used in the present invention may have any base number but is preferably a combination of a metallic detergent having a base number of 150 mgKOH/g or greater and a metallic detergent having a base number of less than 150 mgKOH/g in view of anti-wear properties and prevention of influences of sealing materials after more highly degraded and clutch friction characteristics of an automatic transmission.

The term "total base number" used herein denotes one measured by the perchloric acid potentiometric titration method in accordance with section 7 of JIS K2501 "Petroleum products and lubricants-Determination of neutralization number".

The metallic detergent having a base number of 150 mgKOH/g or greater is preferably a sulfonate or salicylate detergent but particularly preferably a salicylate detergent. The base number is more preferably 200 mgKOH/g or greater and preferably 400 mgKOH/g or less, more preferably 300 mgKOH/g or less.

The metallic detergent having a base number of less than 150 mgKOH/g is preferably a sulfonate or salicylate detergent but particularly preferably a sulfonate detergent. The base number is more preferably 100 mgKOH/g or less, more preferably 80 mgKOH/g or less, particularly preferably 60 mgKOH/g or less. The lower limit is 0 mgKOH/g, that is a neutral salt.

The ratio ([M]/[P]) of the metal amount [M] of the metallic detergent having a base number of less than 150 mgKOH/g in Component (D) to the phosphorus amount [P] of the phosphorus additive that is Component (B) is preferably from 0.06 to 0.3. The ratio set within the above range renders it possible to produce a lubricating oil composition with excellent anti-wear properties when it is fresh or after it is degraded.

In the lubricating oil composition of the present invention, the content of Component (D) is, on the basis of the total mass of the composition, 100 ppm by mass or more, preferably 150 ppm by mass or more and 300 ppm by mass or less, preferably 250 ppm by mass or less as metal. The content of Component (D) set within the above range renders it possible to produce a lubricating oil composition that is excellent in anti-wear properties and prevention of influences of sealing materials after degraded and excellent in clutch friction characteristics of an automatic transmission.

The lubricating oil composition of the present invention contains preferably a thiadiazole as Component (E).

No particular limitation is imposed on Component (E) that is a thiadiazole compound, which may, therefore, have any structure. Examples of thiadiazole compounds with preferable structures include 2,5-bis(alkylthio)-1,3,4-thiadiazole having a straight-chain or branched alkyl group having 6 to 24 carbon atoms; 2,5-bis(alkyldithio)-1,3,4-thiadiazole having a straight-chain or branched alkyl group having 6 to 24 carbon atoms;

2-(alkylthio)-5-mercapto-1,3,4-thiadiazole having a straight-chain or branched alkyl group having 6 to 24 carbon atoms;

2-(alkyldithio)-5-mercapto-1,3,4-thiadiazole having a straight-chain or branched alkyl group having 6 to 24 carbon atoms, and mixtures thereof. Among these, particularly preferred are 2,5-bis(alkyldithio)-1,3,4-thiadiazoles.

The content of Component (E) that is a thiadiazole, if added, in the lubricating oil composition of the present invention is, on the basis of the total mass of the composition, preferably 250 ppm by mass or more, more preferably 350 ppm by mass or more and preferably 1000 ppm by mass or less, more preferably 900 ppm by mass or less, more preferably 700 ppm by mass or less as sulfur.

The above-described structure of the lubricating oil composition of the present invention renders it possible to produce a lubricating oil composition having excellent in anti-wear properties and anti-seizure properties after a rubber immersion test and an oxidation stability test, but in order to further enhance the properties or further provide necessary properties for a lubricating oil composition, conventional lubricating oil additives may be added to an extent that they do not adversely affect the composition of each of the above-described additives.

Examples of additives that may be added in the present invention include ashless dispersants other than Component (A), phosphorus additives other than Component (B), friction modifiers other than Component (C), metallic detergents other than Component (D), anti-oxidants, extreme pressure additives, viscosity index improvers, metal deactivators, rust inhibitors, corrosion inhibitors, pour point depressants, rubber swelling agents, anti-foamers, and colorants. These additives may be used alone or in combination.

The above friction modifier may be any compound that is usually used as a friction modifier for lubricating oil. Examples of such friction modifiers include ester-based friction modifiers, hydroxyl group-based friction modifiers, amine-based friction modifier, fatty acid- or metal fatty acid-based friction modifier, each having at least one alkyl or alkenyl group having 6 to 30 carbon atoms, in particular straight-chain alkyl or alkenyl group having 6 to 30 carbon atoms per molecule.

Examples of the ester-based friction modifier include esters of glycerin and a fatty acid, such as glycerin monooleate.

Examples of the amine-based friction modifier include aliphatic amine-based friction modifiers such as straight-chain or branched, preferably straight-chain aliphatic monoamines having 6 to 30 carbon atoms, straight-chain or branched, preferably straight-chain aliphatic alkanolamines having 6 to 30 carbon atoms, straight-chain or branched, preferably straight-chain aliphatic polyamines, and alkyleneoxide adducts of these aliphatic amines.

Examples of the fatty acid-based friction modifier include straight-chain or branched, preferably straight-chain fatty acid having 7 to 31 carbon atoms, fatty acid esters such as esters of such fatty acids and aliphatic monohydric alcohols or aliphatic polyhydric alcohols, and fatty acid metal salts such as alkaline earth metal salts (magnesium salt, calcium salt) and zinc salt of such fatty acids.

The anti-oxidant may be any of antioxidants that are generally used in lubricating oil such as phenol-based antioxidants and amine-based antioxidants.

Specific examples of the anti-oxidant include alkylphenols such as 2-6-di-tert-butyl-4-methylphenol; bisphenols such as methylene-4,4-bisphenol (2,6-di-tert-butyl-4-methylphenol); naphthylamines such as phenyl-α-naphthylamine; dialkyldiphenylamines; esters of (3,5-di-tert-butyl-4-hydroxyphenyl) fatty acid (propionic acid) with a monohydric or polyhydric alcohol such as methanol, octadecanol, 1,6-hexanediol, neopentyl glycol, thiodiethylene glycol, triethylene glycol and pentaerythritol; phenothiazines; organic metal anti-oxidants such as molybdenum, copper, and zinc; and mixtures thereof.

The extreme pressure additive may be any compound that is used as an extreme pressure additive for a lubricating oil. Examples of the extreme pressure additive include sulfuric compounds such as dithiocarbamates, disulfides, sulfurized olefins, and sulfurized fats and oils. One or more of these compounds may be blended in any amount in the lubricating oil composition of the present invention. However, the content is usually from 0.1 to 5.0 percent by mass, on the basis of the total mass of the composition.

Specific examples of the viscosity index improvers include non-dispersant type viscosity index improvers such as polymers or copolymers of one or more monomers selected from various methacrylic acid esters or hydrogenated compounds thereof; and dispersant type viscosity index improvers such as copolymers of various methacrylic acid esters further containing nitrogen compounds. Specific examples of other viscosity index improvers include non-dispersant- or dispersant-type ethylene-α-olefin copolymers of which the α-olefin may be propylene, 1-butene, or 1-pentene, or a hydrogenated compound thereof; polyisobutylenes or hydrogenated compounds thereof; styrene-diene hydrogenated copolymers; styrene-maleic anhydride ester copolymers; and polyalkylstyrenes.

The molecular weight of the viscosity index improver is selected considering the shear stability. Specifically, the number-average molecular weight of the non-dispersant or dispersant type polymethacrylate is from 5,000 to 150,000, preferably from 10,000 to 100,000. The number-average molecular weight of polyisobutylenes or hydrogenated compounds thereof is from 800 to 5,000, preferably from 1,000 to 4,000. The number-average molecular weight of ethylene-α-olefin copolymers or hydrogenated compounds thereof is from 800 to 15,000, preferably from 3,000 to 12,000.

One or more compounds selected from these viscosity index improvers may be blended in any amount in the lubricating oil composition of the present invention. The content of the viscosity index improver is usually from 0.1 to 20 percent by mass, on the basis of the total mass of the composition.

Examples of the rust inhibitor include alkenyl succinic acids, alkenyl succinic acid esters, polyhydric alcohol esters, petroleum sulfonates, and dinonylnaphthalene sulfonates.

Examples of the corrosion inhibitors include benzotriazole-, tolyltriazole-, and imidazole-type compounds.

Examples of the pour point depressants include polymethacrylate conforming with the lubricating base oil to be used.

Examples of the rubber swelling agents include aromatic- or ester-type rubber swelling agents. Examples of the anti-foamer include silicones such as dimethylsilicone and fluorosilicone.

Although the contents of these additives may be arbitrarily selected, it is usual that the content of the corrosion inhibitor is 0.005 to 0.3 percent by mass, the content of the anti-foamer is 0.00005 to 0.1 percent by mass, and the content of each of the other additives is 0.005 to 10 percent by mass, on the basis of the total mass of the composition.

The lubricating oil composition of the present invention has a 40° C. kinematic viscosity of 30 $mm^2/s$ or lower, preferably 25 $mm^2/s$ or lower, more preferably 23 $mm^2/s$ or lower in view of fuel saving properties.

For the same reason, the lubricating oil composition of the present invention has a 100° C. kinematic viscosity of usually 6.5 $mm^2/s$ or lower, preferably 6.3 $mm^2/s$ or lower, more preferably 6.0 $mm^2/s$ or lower, more preferably 5.7 $mm^2/s$ or lower.

EXAMPLES

Hereinafter, the present invention will be described in more detail by way of the following examples and comparative examples, which should not be construed as limiting the scope of the invention.

The base oils and various additives used in examples and comparative examples are as follows.

[Base Oil]

(1) Mineral oil A: 100° C. kinematic viscosity 2.5 $mm^2/s$, viscosity index 96, S content 0.1 percent by mass or less (2) Mineral oil B: 100° C. kinematic viscosity 4.2 $mm^2/s$, viscosity index 125, S content 0.1 percent by mass or less

[Component A]

(1) Boron-containing succinimide: Mw 3200, N content 2.2 percent by mass, B content 0.46 percent by mass, bis compound

[Component B]

(1) Phosphite ester: diphenyl hydrogen phosphite (2) Phosphoric Acid

[Component C]

(1) Amide-based friction modifier: reaction product of glycolic acid and an amine containing octadecylamine as the main component (2) Imide-based friction modifier: reaction product of tetradecylsuccinic anhydride and triethylenetetramine

[Component D]

(1) Low base number detergent: calcium sulfonate, base number 15 mgKOH/g, Ca content 2.5 percent by mass (2) High base number detergent A: calcium salicylate, base number 225 mgKOH/g, Ca content 8.0 percent by mass (3) High base number detergent B: calcium sulfonate, base number 300 mgKOH/g, Ca content 12.0 percent by mass

[Component E]

(1) Thiadiazole: 1,3,4-thiadiazole compound

[Other Performance Additives]

(1) Mixture of anti-oxidant, viscosity index improver, friction modifier, sealing agent, and metal deactivator

Examples 1 to 11 and Comparative Examples 1 to 8

Lubricating oil compositions of Examples 1 to 11 (prepared to have a 100° C. kinematic viscosity of 5.5 $mm^2/s$) set forth in Table 1 and those of Comparative Examples 1 to 8 for comparison set forth in Table 2 were prepared and evaluated in respect of (1) anti-wear properties and (2) anti-seizure properties (extreme pressure properties) when they were fresh and after they were subjected to an oxidation stability test and a rubber immersion test. The results are also set forth in Tables 1 and 2. The ratio of each base oil is on the basis of the total mass of the oil, and the amount of each additive is on the basis of the total mass of the composition.

(1) Anti-Wear Properties

Anti-wear properties were evaluated by measuring the wear scar diameter in a Shell four-ball test in accordance with ASTM D4172 where the load was 392 N, the revolution number was 1900 rpm and the oil temperature was 100° C. and the balls are slid to each other for one hour.

(2) Anti-Seizure Properties

Anti-seizure properties were evaluated by measuring the weld load (WL) in a Shell four-ball test in accordance with ASTM D2783 at a revolution number of 1800 rpm and room temperature.

(3) Oxidation Stability Test

An oxidation stability test was carried out at an oil temperature of 150° C. for 96 hours in accordance with JIS K 2514.

(4) Sealing Material Immersion Test

A sealing material immersion test was carried out by immersing an acrylic rubber material (T712) in oil kept at a temperature of 150° C. for 240 hours in accordance with JIS K 6258.

(5) Anti-Shudder Life

Anti-shudder life was evaluated with JASO M349-2010.

As apparent from the results set forth in Tables 1 and 2, the compositions of the examples according to the present invention have been found to have high load bearing properties equivalent to those of the compositions when they are fresh even after being subjected the oxidation stability test and rubber immersion test. Whilst, the comparative examples do not meet any of the structural requirements of the present invention and thus were extremely poor in anti-wear properties and/or anti-seizure properties compared with those of the composition when they are fresh after being subjected to the oxidation stability test and/or rubber immersion test.

TABLE 1

| | | | | Example 1 | Example 2 | Example 3 | Example 4 | Example 5 | Example 6 | Example 7 | Example 8 | Example 9 | Example 10 | Example 11 |
|---|---|---|---|---|---|---|---|---|---|---|---|---|---|---|
| Lubricating base oil | | Mineral oil A | % | 60 | 60 | 60 | 60 | 60 | 60 | 60 | 60 | 60 | 60 | 60 |
| | | Mineral oil B | % | 40 | 40 | 40 | 40 | 40 | 40 | 40 | 40 | 40 | 40 | 40 |
| Performance additives | A | Boron-containing succinimide [B] | ppm/B | 250 | 150 | 450 | 250 | 250 | 250 | 250 | 250 | 250 | 250 | 250 |
| | B | Phosphoric acid [P2] | ppm/P | 200 | 200 | 200 | 100 | 100 | 50 | 350 | 0 | 200 | 100 | 200 |
| | | Phosphite ester [P1] | ppm/P | 400 | 200 | 600 | 500 | 300 | 550 | 250 | 600 | 600 | 400 | 400 |
| | | Phosphorus amount Total [P] | ppm/P | 600 | 400 | 800 | 600 | 400 | 600 | 600 | 600 | 800 | 500 | 600 |
| | | P ratio: [P2]/[P1] | | 0.5 | 1 | 0.33 | 0.2 | 0.33 | 0.09 | 1.4 | 0 | 0.33 | 0.25 | 0.5 |
| | A/B | Boron-containing succinimide [B]]/ Phosphorus additive [P] | | 0.42 | 0.38 | 0.56 | 0.42 | 0.63 | 0.42 | 0.42 | 0.42 | 0.31 | 0.5 | 0.42 |
| | C | Amide-based FM | mass % | 3 | 4 | 2 | | | 3 | 3 | 3 | 3 | 3 | 3 |
| | | Imide-based FM | mass % | | | | 2 | 3 | | | | | | |
| | D | Ca sulfonate (less than 50 mgKOH/g) | ppm/Ca | 100 | 50 | 50 | 50 | 100 | 100 | 100 | 100 | 30 | 150 | 0 |
| | | Ca salicylate (200 mgKOH/g) | ppm/Ca | 100 | 200 | 200 | | | 100 | 100 | 100 | 100 | 100 | 200 |
| | | Ca sulfonate (400 mgKOH/g) | ppm/Ca | | | | 50 | 100 | | | | | | |
| | | Ca amount Total | | 200 | 250 | 250 | 100 | 200 | 200 | 200 | 200 | 130 | 250 | 200 |
| | D/B | Low base number Ca amount/ Phosphorus amount [P] | | 0.167 | 0.125 | 0.063 | 0.083 | 0.25 | 0.167 | 0.167 | 0.167 | 0.038 | 0.3 | 0 |
| | E | Thiadiazole | ppm/S | 540 | 360 | 900 | 540 | 540 | 540 | 540 | 540 | 540 | 540 | 540 |
| | Others | Other performance additives | | 9 | 9 | 9 | 9 | 9 | 9 | 9 | 9 | 9 | 9 | 9 |
| | 40° C. kinematic viscosity | | $mm^2/s$ | 22.5 | 22.5 | 22.5 | 22.5 | 22.5 | 22.5 | 22.5 | 22.5 | 22.5 | 22.5 | 22.5 |
| | 100° C. kinematic viscosity | | $mm^2/s$ | 5.5 | 5.5 | 5.5 | 5.5 | 5.5 | 5.5 | 5.5 | 5.5 | 5.5 | 5.5 | 5.5 |
| Test | | Anti-wear properties | | | | | | | | | | | | |
| | | Fresh oil | mm | 0.38 | 0.42 | 0.42 | 0.43 | 0.42 | 0.46 | 0.47 | 0.48 | 0.51 | 0.48 | 0.55 |
| | | Oxidation stability test: after ISOT degradation | mm | 0.39 | 0.42 | 0.44 | 0.44 | 0.44 | 0.48 | 0.48 | 0.48 | 0.52 | 0.52 | 0.56 |
| | | Sealing material immersion test: after immersion | mm | 0.39 | 0.43 | 0.43 | 0.44 | 0.44 | 0.48 | 0.48 | 0.49 | 0.53 | 0.52 | 0.57 |
| | | Anti-seizure properties | | | | | | | | | | | | |
| | | Fresh oil | N | 1961 | 1961 | 1961 | 1961 | 1961 | 1961 | 1961 | 1961 | 1961 | 1961 | 1569 |
| | | Oxidation stability test: after ISOT degradation | N | 1961 | 1961 | 1961 | 1961 | 1961 | 1961 | 1961 | 1961 | 1961 | 1569 | 1569 |
| | | Sealing material immersion test: after immersion | N | 1961 | 1961 | 1961 | 1961 | 1961 | 1961 | 1961 | 1961 | 1961 | 1569 | 1569 |
| | | Anti-shudder life | h | >300 | >300 | >300 | >300 | >300 | >300 | >300 | >300 | >300 | >300 | >300 |

TABLE 2

| | | | | Comparative Example 1 | Comparative Example 2 | Comparative Example 3 | Comparative Example 4 | Comparative Example 5 | Comparative Example 6 | Comparative Example 7 | Comparative Example 8 |
|---|---|---|---|---|---|---|---|---|---|---|---|
| Lubricating base oil | | Mineral oil A | % | 60 | 60 | 60 | 60 | 60 | 60 | 60 | 60 |
| | | Mineral oil B | % | 40 | 40 | 40 | 40 | 40 | 40 | 40 | 40 |
| Performance additives | A | Boron-containing succinimide [B] | ppm/B | 50 | 600 | 250 | 250 | 250 | 250 | 250 | 250 |
| | B | Phosphoric acid [P2] | ppm/P | 200 | 200 | 100 | 300 | 200 | 200 | 100 | 200 |
| | | Phosphorus acid ester [P1] | ppm/P | 200 | 400 | 100 | 600 | 400 | 400 | 300 | 400 |
| | | Phosphorus amount Total [P] | ppm/P | 400 | 600 | 200 | 900 | 600 | 600 | 400 | 600 |
| | | P ratio: [P2]/[P1] | | 1 | 0.5 | 1 | 0.5 | 0.5 | 0.5 | 0.33 | 0.5 |
| | A/B | Boron-containing succinimide [B]]/Phosphorus additive [P] | | 0.13 | 1 | 1.25 | 0.28 | 0.42 | 0.42 | 0.63 | 0.42 |
| | C | Amide-based FM | mass % | 3 | 3 | 3 | 3 | 0.5 | 5 | 3 | 3 |
| | | Imide-based FM | mass % | | | | | | | | |
| | D | Ca sulfonate (less than 50 mgKOH/g) | ppm/Ca | 100 | 100 | 50 | 100 | 100 | 100 | 30 | 50 |
| | | Ca salicylate (200 mgKOH/g) | ppm/Ca | 150 | 100 | 100 | 100 | 100 | 100 | 50 | 300 |
| | | Ca sulfonate (400 mgKOH/g) | ppm/Ca | | | | | | | | |
| | | Ca amount Total | | 250 | 200 | 150 | 200 | 200 | 200 | 80 | 350 |
| | D/B | Low base number Ca amount/Phosphorus amount [P] | | 0.25 | 0.167 | 0.25 | 0.111 | 0.167 | 0.167 | 0.075 | 0.083 |
| | E | Thiadiazole | ppm/S | 540 | 540 | 540 | 540 | 540 | 540 | 540 | 540 |
| | Others | Other performance additives | | 9 | 9 | 9 | 9 | 9 | 9 | 9 | 9 |
| | 40° C. kinematic viscosity | | $mm^2/s$ | 22.5 | 22.5 | 22.5 | 22.5 | 22.5 | 22.5 | 22.5 | 22.5 |
| | 100° C. kinematic viscosity | | $mm^2/s$ | 5.5 | 5.5 | 5.5 | 5.5 | 5.5 | 5.5 | 5.5 | 5.5 |
| Test | Anti-wear properties | | | | | | | | | | |
| | | Fresh oil | mm | 0.54 | 0.54 | 0.65 | 0.51 | 0.61 | 0.52 | 0.54 | 0.58 |
| | | Oxidation stability test: after ISOT degradation | mm | 0.54 | 0.65 | 0.66 | 0.52 | 0.61 | 0.54 | 0.68 | 0.61 |
| | | Sealing material immersion test: after immersion | mm | 0.61 | 0.54 | 0.64 | 0.65 | 0.6 | 0.65 | 0.55 | 0.6 |
| | Anti-seizure properties | | | | | | | | | | |
| | | Fresh oil | N | 1569 | 1569 | 1569 | 1961 | 1569 | 1961 | 1569 | 1569 |
| | | Oxidation stability test: after ISOT degradation | N | 1569 | 1236 | 1569 | 1569 | 1569 | 1569 | 1236 | 1569 |
| | | Sealing material immersion test: after immersion | N | 1236 | 1569 | 1569 | 1236 | 1569 | 1236 | 1569 | 1569 |
| | | Anti-shudder life | h | >300 | 216 | >300 | 288 | 144 | >300 | >300 | 240 |

The invention claimed is:

1. A lubricating oil composition comprising a lubricating base oil and on the basis of the total mass of the composition, (A) a boron-containing ashless dispersant in an amount of 100 to 500 ppm by mass as boron, (B) a phosphorus additive in an amount of 300 to 800 ppm by mass as phosphorus, (C) an amide- and/or imide-based friction modifier in an amount of 1 to 4 percent by mass, and (D) an alkali metal- and/or alkaline earth metal-based detergent in an amount of 100 to 300 ppm by mass as metal, wherein the composition has a 40° C. kinematic viscosity of 25 $mm^2/s$ or lower and a 100° C. kinematic viscosity of 6.5 $mm^2/s$ or lower, wherein Component (B) comprises a combination of a phosphite ester and phosphoric acid having a ratio ([P2]/[P1]) of the phosphorus amount [P2] of the phosphoric acid to the phosphorus amount [P1] of the phosphite ester of 0.2 to 1.0;

wherein Component (D) comprises a metallic detergent having a base number of less than 150 mgKOH/g and has a ratio ([M]/[P]) of the metal amount [M] of the metallic detergent to the phosphorus amount [P] of Component (B) of 0.06 to 0.25;

wherein the phosphite ester is a phosphite ester having an (alkyl)aryl group having 6 to 12 carbon atoms and the metallic detergent is a calcium sulfonate detergent.

2. The lubricating oil composition according to claim 1, wherein Component (D) further comprises a metallic detergent having a base number of 200 mgKOH/g or greater.

3. The lubricating oil composition according to claim 1, further comprising (E) a thiadiazole in an amount of 250 to 1000 ppm by mass as sulfur on the basis of the total mass of the composition.

4. The lubricating oil composition according to claim 1, wherein the composition is used in a vehicle transmission.

5. The lubricating oil composition according to claim 1, wherein the amide-based friction modifier of Component (C) comprises compounds represented by formula (3):

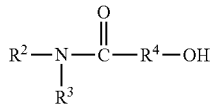

(3)

wherein $R^2$ is a hydrocarbon or functionalized hydrocarbon group having 1 to 30 carbon atoms, $R^3$ is a hydrocarbon or functionalized hydrocarbon group having 1 to 30 carbon atoms or hydrogen and $R^4$ is a divalent hydrocarbon or functionalized divalent hydrocarbon group having 1 to 10 carbon atoms.

6. The lubricating oil composition according to claim 5, wherein in formula (3), $R^3$ is hydrogen.

7. The lubricating oil composition according to claim 1, wherein the imide-based friction modifier of Component (C) comprises compounds represented by formula (4) or (5):

(4)

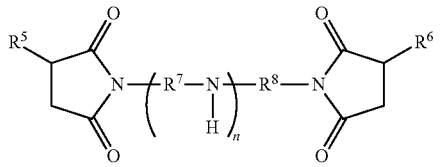

(5)

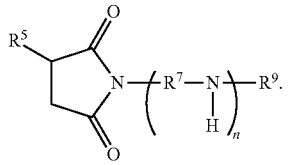

wherein $R^5$ and $R^6$ are each independently an alkyl or alkenyl group having 8 to 30 carbon atoms, $R^7$ and $R^8$ are each independently an alkylene group having 1 to 4 carbon atoms, $R^9$ is hydrogen or an alkyl or alkenyl group having 1 to 30 carbon atoms and n is an integer of 1-7.

8. The lubricating oil composition according to claim 1, wherein Component (D) further comprises a metallic detergent having a base number of 200 mgKOH/g or greater and is a calcium salicylate detergent.

* * * * *